US005570998A

United States Patent [19]

Nomoto

[11] Patent Number: 5,570,998

[45] Date of Patent: Nov. 5, 1996

[54] IMPELLER STRUCTURE OF CLOSED TYPE CENTRIFUGAL PUMP

[75] Inventor: Yuji Nomoto, Atsugi, Japan

[73] Assignee: Unisia Jecs Corporation, Atsugi, Japan

[21] Appl. No.: 545,534

[22] Filed: Oct. 19, 1995

[30] Foreign Application Priority Data

Oct. 21, 1994 [JP] Japan ..... 6-255936

[51] Int. Cl.[6] ..... F04D 29/24

[52] U.S. Cl. ..... 416/186 R; 416/203; 416/223 B

[58] Field of Search ..... 416/183, 186 R, 416/188, 223 B, 203

[56] References Cited

FOREIGN PATENT DOCUMENTS 58-177584 11/1983 Japan .

59-115498 7/1984 Japan ..... 416/186 R 385078 9/1973 U.S.S.R. ..... 416/186 R 1521924 11/1989 U.S.S.R. ..... 416/223 B

*Primary Examiner*—James Larson

*Attorney, Agent, or Firm*—Foley & Lardner

[57] ABSTRACT

An impeller structure of a closed type centrifugal pump suitable for inelastic fluids such as an engine coolant, comprises front and rear shrouds having a driven connection with a pump drive shaft, and a series of blades provided between the front and rear shrouds for pressurizing an incoming fluid. An inner edge (17*a*) of a first blade of two adjacent blades is formed to be up-sloped from its inside corner to its outside corner, whereas an inner edge (17*c*) of a second blade of the two adjacent blades is formed to be down-sloped from its outside corner to its inside corner, so as to enhance an efficiency of the pump, suppressing occurrence of cavitation at or near the pump inlet.

5 Claims, 3 Drawing Sheets

IMPELLER STRUCTURE OF CLOSED TYPE CENTRIFUGAL PUMP

BACKGROUND OF THE INVENTION

1. Field of the Invention

The present invention relates to a closed type centrifugal pump, and specifically to an impeller structure of a closed type centrifugal pump which is optimally applied to a water pump for use in an automotive-engine liquid-cooling system.

2. Description of the Prior Art

As is generally known, two general types of water pumps suitable for automotive-engine liquid-cooling systems are used: one being an open type centrifugal pump with a rotor having a series of flat or curved vanes or blades on its outer-periphery, and the other being a closed type centrifugal pump with a pair of shrouds formed with a series of blades therebetween. One such closed type centrifugal pump has been disclosed in Japanese Utility-Model provisional publication (Jikkai Showa) No. 58-177584. FIG. 5 shows a structure of the centrifugal pump as disclosed in the Japanese Utility-Model provisional publication No. 58-177584.

Referring now to FIG. 5, the prior art centrifugal pump includes a pump housing 1 which defines a pump chamber 2, a pump shaft 3 which is inserted into the pump chamber 2 and has a driven connection with the engine crankshaft (not shown), and an impeller 4 which is rotatably provided in the pump chamber 2. As seen in FIG. 5, the impeller 4 is firmly secured onto one end of the pump shaft 3 by means of a nut 10. The impeller 4 comprises a rear shroud 5 whose inner peripheral boss-like portion 5*a* is fixedly connected to the end of the pump shaft 3 by the aid of the nut 10, a front shroud 6 which is located in front of the rear shroud 5 in such a manner as to face the inside curved surface of the rear shroud 5, and a series of blades 7 circumferentially equidistantly disposed between these shrouds 5 and 6. As shown in FIG. 5, the rear shroud 5 is often formed with a pressure-balance hole 5*b* which is provided for reducing a pressure difference between fluid pressures respectively applied to inside and outside wall surfaces of the rear shroud 5, thus reducing undesired thrust acting on the pump shaft 3, and a substantially annular fluid-flow restricting portion 5*c* which is provided for restricting the outgoing fluid from the pressure-balance hole 5*b* and around the pump shaft 3 from being directed toward the outer periphery of the impeller 4. Although it is not clearly shown, the respective blades 7 are backwardly curved with respect to the rotational direction of the impeller 4 and arranged in a vortex fashion. The inner (suction side) edge 7*a* of each blade 7 faces the pump inlet 8, whereas the outer (pressure side) edge 7*b* of the blade 7 lies flush with the outermost end of the respective shrouds 5 and 6 and faces the pump outlet 9.

With the above-noted arrangement, when the impeller 4 rotates by rotation of the pump shaft 3, the incoming fluid (the coolant) from the pump inlet 8 is thrown outward through a fluid passage defined between the opposing faces of the two adjacent blades 7 and the opposing inside wall surfaces of the two shrouds 5 and 6, by centrifugal force, and thus the pressurized coolant is forced through the pump outlet 9 and into the water jackets of the engine cylinder block or head.

In the above-mentioned conventional closed type centrifugal pump applied to the forced circulation system, as clearly seen in FIG. 5, the inner edge 7*a* of the blade 7 is slightly inclined in such a manner as to extend from the inside curved wall of the front shroud 6 to the inner peripheral boss-like portion 5*a* of the rear shroud 5. The shapes of the respective blades 7, namely dimensions and geometry, are identical with each other. That is, the inner edge 7*a* of the respective blade 7 has the same inclined angle as indicated in FIG. 5. Therefore, in case that the number of the blades 7 of the same shape is increased simply for the purpose of enhancing a pump efficiency, the overall thickness of the inner edges 7*a* of all blades 7 is proportionally increased depending on the increased number, thus reducing the overall area of the fluid-flow passageway in the vicinity of the pump inlet 8. As is well known as Bernoulli theorem, when an incompressible (inelastic) fluid flows through a narrower fluid passageway, the fluid velocity will be increased at the narrower area, whereas the fluid pressure is reduced. As a result of the reduction of the overall passage area, the pressure of the coolant tends to be lowered at the pump inlet 8, and remarkably reduced particularly just after the pump inlet. In this case, there is a tendency for cavitation to easily occur. Additionally, there is a possibility that the pump efficiency is reduced owing to collision between the incoming coolant and the respective inner blade edges 7*a* of the increased number.

SUMMARY OF THE INVENTION

Accordingly, it is an object of the invention to provide an improved impeller structure of a closed type centrifugal pump suitable for an automotive-engine liquid-cooling system which avoids the foregoing disadvantages of the prior art.

It is an object of the present invention to provide an impeller structure of a closed type centrifugal pump which can provide an increased overall passage area at or near the pump inlet so as to enhance its pump efficiency.

It is another object of the invention to provide an impeller structure of a closed type centrifugal pump which can prevent the overall passage area from being reduced at or near the pump inlet, even when the number of blades of the pump impeller is increased.

It is a further object of the invention to provide an impeller structure of a closed type centrifugal pump which can relax collision between the inner edges of the blades of the pump impeller and the incoming coolant from the pump inlet, as much as possible.

It is a still further object of the invention to provide an impeller structure of a closed type centrifugal pump which can ensure enhancement of an efficiency of the pump, while preventing cavitation and/or turbulent flow from occurring at or near the pump inlet, as much as possible.

In order to accomplish the aforementioned and other objects of the invention, an impeller structure of a closed type centrifugal pump, comprises front and rear shrouds having a driven connection with a pump drive shaft, and a series of blades provided between the front and rear shrouds for pressurizing an incoming fluid, wherein an inner edge (17*a*) of a first blade of two adjacent blades of the series of blades is formed to be upsloped from its inside corner to its outside corner, whereas an inner edge (17*c*) of a second blade of the two adjacent blades is formed to be downsloped from its outside corner to its inside corner.

According to another aspect of the invention, an impeller structure of a closed type centrifugal pump for inelastic fluids, comprises front and rear shrouds having a driven connection with a pump drive shaft, and a series of blades provided between the front and rear shrouds for pressurizing an incoming inelastic fluid, and backwardly curved with respect to a rotational direction of an impeller and arranged circumferentially equidistantly in a vortex fashion, wherein an inner edge (17*a*) of a first blade of two adjacent blades of the series of blades is formed to be down-sloped from an inside wall of the rear shroud toward a substantially central portion of the front shroud, whereas an inner edge (17*c*) of a second blade of the two adjacent blades is formed to be down-sloped from an inside wall surface of the front shroud toward a substantially center portion of the rear shroud. The first and second blades are formed integral with the front and rear shrouds so that the inner edge (17*a*) of the first blade and the inner edge (17*c*) of the second blade are crossed to each other substantially on a central streamline of the fluid between the first and second blades, from a view in a circumferential direction of an impeller.

According to a further aspect of the invention, an impeller structure of a closed type centrifugal pump for inelastic fluids, comprises front and rear shrouds having a driven connection with a pump drive shaft, the front shroud including an axially-extending inner peripheral portion, a radially-extending circumferential portion slightly inclined to a radial direction of an impeller, and an inner curved wall with respect to a central streamline of an incoming inelastic fluid, the inner curved wall interconnecting the axially-extending inner peripheral portion and the radially-extending circumferential portion, the rear shroud including an inner peripheral boss-like portion having an outer curved wall with respect to the central streamline of the inelastic fluid and a radially-extending circumferential portion having an essentially flat wall, and a series of blades provided between the front and rear shrouds for pressurizing the inelastic fluid, and backwardly curved with respect to a rotational direction of the impeller and arranged circumferentially equidistantly in a vortex fashion, wherein an inner edge (17*a*) of a center blade of three adjacent blades of the series of blades extends from the inner curved wall of the front shroud in such a manner as to be up-sloped from its inside corner to its outside corner, whereas a respective inner edge (17*c*) of both sides of the three adjacent blades extends from the outer curved wall of the rear shroud in such a manner as to be up-sloped from its inside corner to its outside corner.

DESCRIPTION OF THE PREFERRED EMBODIMENTS

Figure 1:
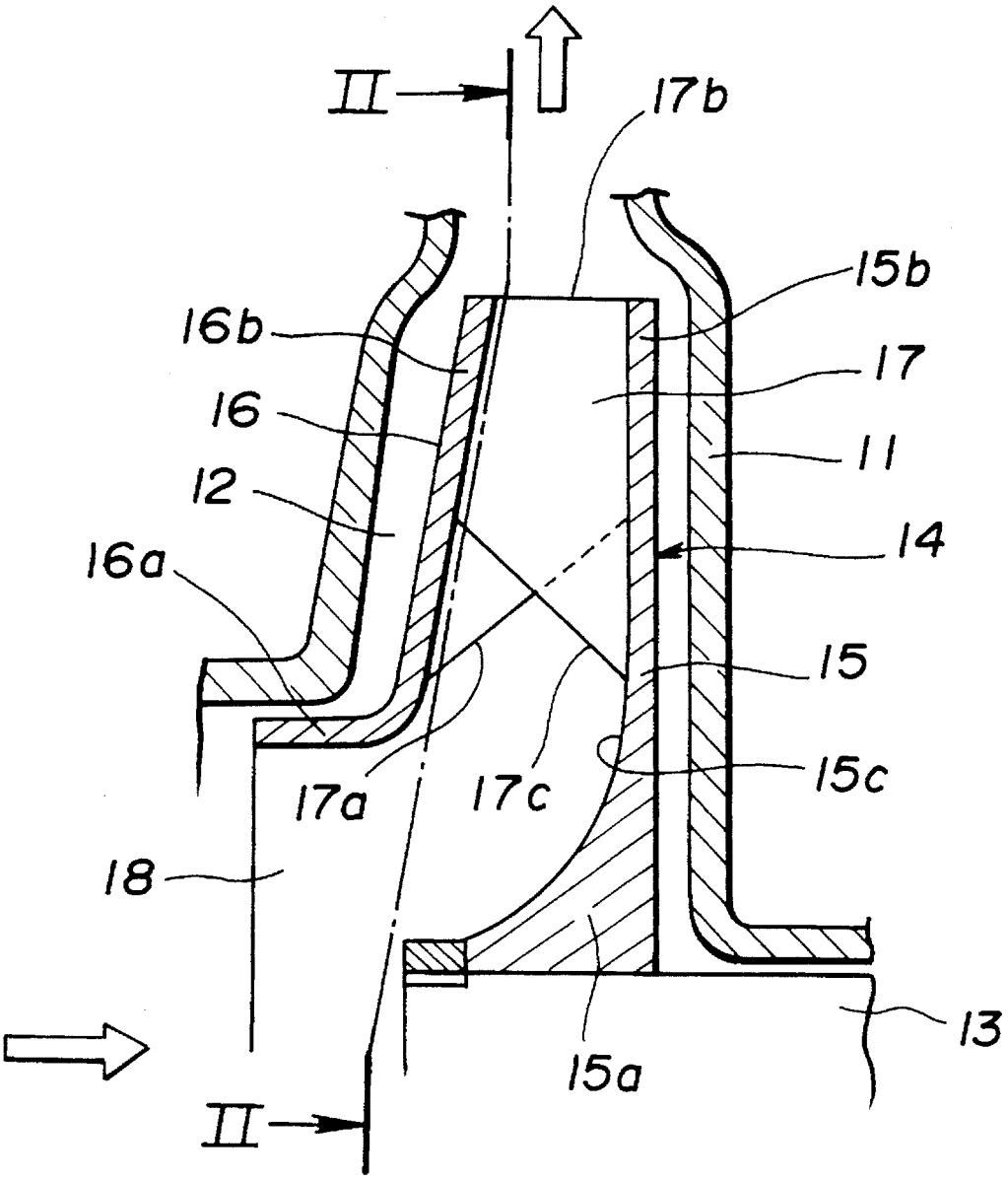
FIG. 1 is a side view, taken in the direction of the arrow X (from the circumferential direction) of FIG. 2, partly cross-sectioned and illustrating one embodiment of a closed type centrifugal pump according to the invention.
Figure 2:
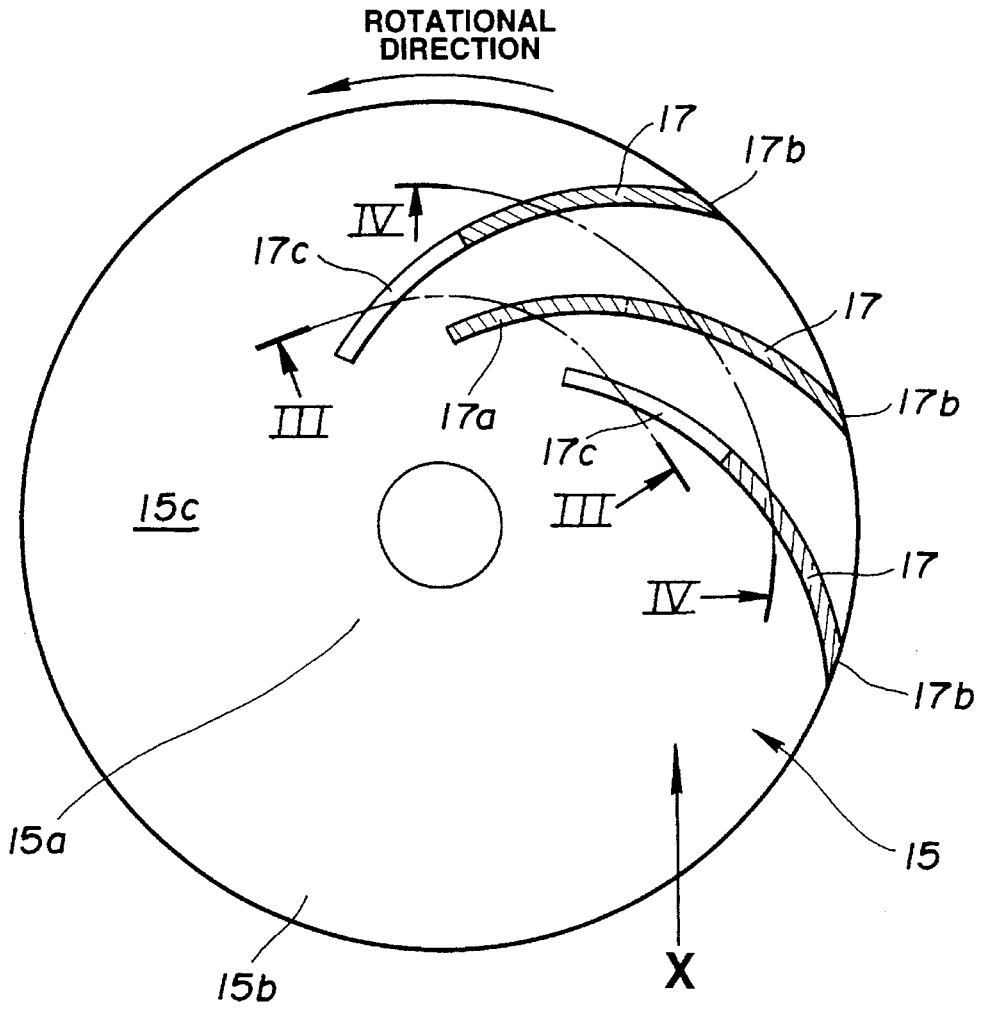
FIG. 2 is a cross-section of the impeller, taken along the lines A—A of FIG. 1.
Figure 3:
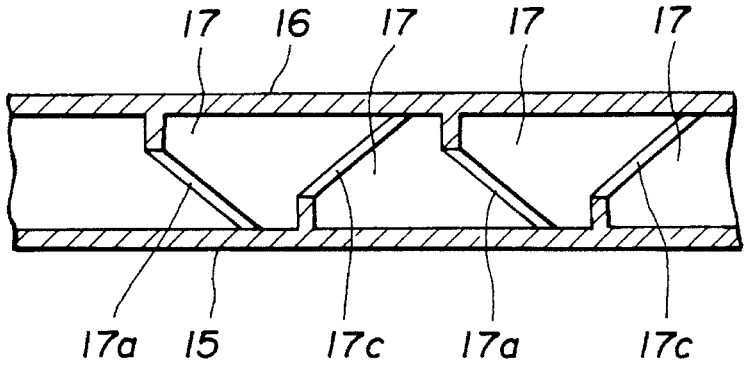
FIG. 3 is a cross-sectional view, taken along the curved lines B—B of FIG. 2.
Figure 4:
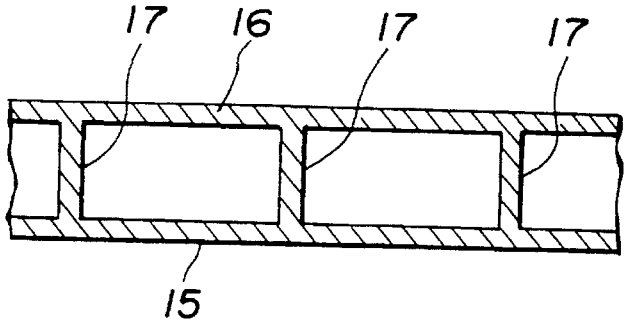
FIG. 4 is a cross-sectional view, taken along the curved lines C—C of FIG. 2.
Figure 5:
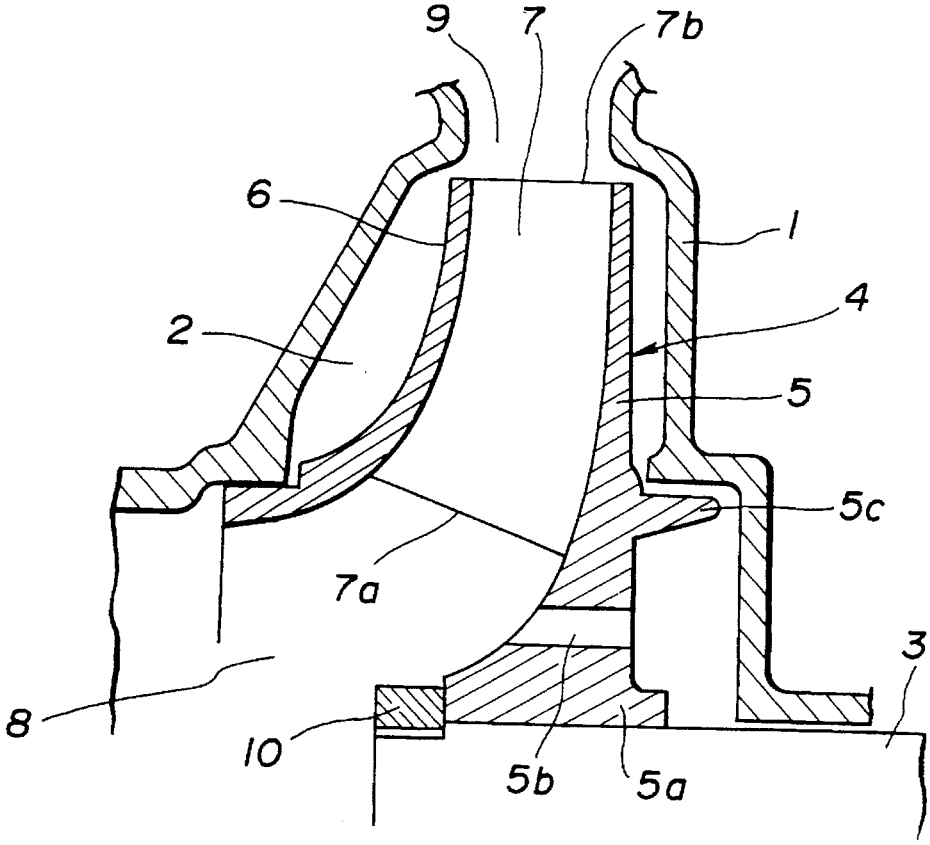
FIG. 5 (PRIOR ART)
FIG. 5 is a side view illustrating a conventional closed type centrifugal pump, partly cross-sectioned.

Referring now to the drawings, particularly to FIGS. 1 and 2, the closed-type centrifugal pump of the embodiment includes a pump housing 11 defining a pump chamber 12 therein, a pump impeller 14 operably provided in the pump chamber 12, and a pump shaft 13 inserted into the pump chamber 12 for the purpose of rotating the impeller 14. The impeller 14 of the closed-type centrifugal pump comprises a rear shroud 15 having an essentially curved inside wall surface 15*c* at its inner peripheral boss-like portion 15*a* and an essentially flat inside wall surface 15*c* at its radially-extending circumferential portion 15*b*, a front shroud 16 located in front of the rear shroud 15 such that the inside wall surface of the front shroud 16 opposes the inside wall surface 15*c* of the rear shroud 15, and a series of vanes or blades 17 which blades are provided between the two opposing inside wall surfaces of the shrouds 15 and 16 and integrally connected to both the two opposing shrouds. The rear shroud 15 is mounted on the front end of the pump shaft 13 through a center bore of the comparatively thick boss-like portion 15*a* and firmly secured onto the pump shaft 13 ordinarily by means of a nut. On the other hand, the front shroud 16 consists of a substantially cylindrical axially-extending inner peripheral portion 16*a*, a substantially annular radially-extending circumferential portion 16*b* slightly inclined to the vertical line (in the radial direction of the impeller), and an intermediate bent portion (the inner curved wall surface with respect to the streamline of the incoming coolant) interconnecting the axially-extending inner peripheral portion 16*a* and the radially-extending circumferential portion 16*b*. The axially-extending inner peripheral portion 16*a* of the front shroud 16 and the boss-like portion 15*a* of the rear shroud 15 are cooperative with each other to define a pump inlet (coolant inlet) therebetween. The pump inlet 18 communicates the coolant supply passageway (not shown). As can be appreciated from FIGS. 1 and 2, the respective blades 17 are formed integral with both the shrouds 15 and 16 and provided vortically between the radially-extending circumferential portion 15*b* of the rear shroud and the radially-extending circumferential portion 16*b* of the front shroud. As clearly seen in FIG. 2, the respective blades 17 are backwardly curved with respect to the rotational direction of the impeller 14 and arranged circumferentially equidistantly in a vortex fashion. The outer (discharge side or pressure side) edge 17*b* of each blade 17 lies flush with the outermost end of the respective shrouds 15 and 16. Note that respective inclined angles of inner (suction side) edges 17*a* and 17*c* of the two adjacent blades 17 are different from each other, as seen in FIGS. 1 to 3. As clearly seen in FIG. 3, the two adjacent blades, namely a blade with the inner edge 17*a* of a first inclined angle and a blade with the inner edge 17*c* of a second inclined angle different from the first inclined angle are arranged alternately to each other in the circumferential direction of the impeller 14. That is to say, as shown in FIG. 1, the inner edge 17*a* of one of the two adjacent blades 17 is sloped from the essentially flat inside wall surface 15*c* of the rear shroud 15 essentially down to the intermediate bent portion formed integral with the axially-extending inner peripheral portion 16*a* of the front shroud 16, while the inner edge 17*c* of another blade 17 is down-sloped from the radially-extending circumferential portion 16*b* of the front shroud 16 toward the rear-shroud boss-like portion 15*a*, particularly configuring the outer curved wall surface with respect to the streamline of the incoming coolant. In the shown embodiment, the inner edges 17*a* and 17*c* of the two adjacent blades 17 are sloped in different directions, such that the inner edges 17*a* and 17*c* are crossed to each other substantially on a central streamline of the coolant between the blades, from the view in the circumferential direction as indicated in FIG. 1. In other words, from the view in the radial direction of the impeller as indicated in FIG. 3, the inner edges 17*a* and 17*c* of the two adjacent blades 17 are sloped in the different directions, so that one inner edge 17*a* is gradually down-sloped from the inside wall surface of the front shroud 16 toward the inside wall surface 15*c* of the rear shroud 15, (i.e., from the inside corner of the inner edge 17*a* to the outside corner of the inner edge 17*a*), whereas another inner edge 17*c* is gradually up-sloped from the inside wall 15*c* of the rear shroud 15 toward the inside wall of the front shroud 16, (i.e., from the inside corner of the inner edge 17*c* to the outside corner of the inner edge 17*c*). In consideration of streamlines of the coolant flowing through the pump inlet 18, as indicated by the arrows in FIG. 1, the coolant flows from the impeller 14 via the inner edge 17*c* of the blade 17, such that more of fluid mass of the incoming coolant will flow across the inner edge 17*c* sloped toward the boss-like portion 15*a* of the rear shroud 15, and mainly guided along the inside wall surface 15*c* of the rear shroud 15. Particularly when the flow rate of the coolant is comparatively low, more of the incoming coolant flows across the right-hand side (viewing FIG. 1) of the inner edge 17*c*, some of the incoming coolant tends to flow turbulently at the left-hand side (viewing FIG. 1) of the inner edge 17*c*, namely in the vicinity of the outside corner of the inner edge 17*c*. That is, the low flow rate of the coolant tends to produce back flow or turbulent flow such as vortex-like stagnant coolant near the outside corner of the blade inner edge 17*c*. As can be appreciated, more of the incoming coolant tends to collide with the right-hand side of the edge 17*c* rather than the left-hand side of the edge 17*c*, at the pump inlet 18. For the reasons set out above, in the impeller structure made according to the invention, the collision between the incoming coolant and the inner blade edges 17*a* is relaxed, since the inner edge 17*a* of the blade interleaved between the two adjacent blades of the inner edge 17*c* is inclined or sloped substantially along the flow direction (the streamline) of the coolant. This contributes to enhancement of the pump efficiency. Additionally, the left-hand side of the additionally interleaved blade of the inner edge 17*a* serves as a straightening vane which will prevent undesirable turbulent flow at the outside corner of the blade inner edge 17*c*. It will be appreciated that the inclined angles of the inner edges 17*a* and 17*c* can be properly varied depending on desired characteristics of a centrifugal pump or a desired technical specification of the pump, such as a net pump head, a maximum working pressure, a discharge of the pump, a maximum rotational speed of the pump and the like.

Furthermore, as appreciated from the cross-section of FIG. 3, the two adjacent blades 17 having the respective inner edges 17*a* and 17*c*, which edges are inclined or sloped in the different directions, are alternately arranged to each other, and thus the pitch between the two adjacent blades of the identical inclined angle of the blade inner edge can be regarded as being enlarged. As a result, the overall area of the fluid-flow passageway can be actually enlarged at and near the inner edges of the blades 17 in the vicinity of the pump inlet 18, as compared with when the blades of the inner edge 17*a* are all replaced with the blade of the inner edge 17*c*. As can be appreciated from the above, even when the number of the blades 17 is increased, the impeller structure of the present invention can prevent the overall area of the fluid-flow passageway near the blade inner edges from being undesiredly reduced. The reduction of the fluid pressure, which will occur near the blade inner edges, can be effectively suppressed, thus avoiding occurrence of cavitation in the closed-type centrifugal pump.

Moreover, the pump impeller 14 can be easily molded or formed, since the two adjacent blades 17, namely the blade of the inner edge 17*a* and the blade of the inner edge 17*c*, are arranged alternately to each other in the circumferential direction of the pump impeller so that their inclined angles are different from each other. The increase in the production costs of the closed type centrifugal pump may be suppressed to a minimum.

In the shown embodiment, although essentially straight inner edges 17*a* and 17*c* are crossed to each other substantially on a central streamline of the coolant flowing between the two adjacent blades 17, from the view in the circumferential direction of the pump impeller, slightly curved inner edges are crossed to each other substantially on the central streamline of the coolant between the blades. That is, the shape of the inner edge is not limited to a straight edge. For example, the edge shape may be so designed as to be slightly curved, depending on a desired technical specification of the pump.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An impeller structure of a closed type centrifugal pump, comprising:

front and rear shrouds having a driven connection with a pump drive shaft; and a series of blades provided between said front and rear shrouds for pressurizing an incoming fluid, wherein an inner edge (17*a*) of a first blade of two adjacent blades of said series of blades is formed to be up-sloped from an inside corner to an outside corner, whereas an inner edge (17*c*) of a second blade of said two adjacent blades is formed to be down-sloped from an outside corner to an inside corner.

2. An impeller structure as claimed in claim 1, wherein said first and second blades are formed integral with said front and rear shrouds so that said inner edge (17*a*) of said first blade and said inner edge (17*c*) of said second blade are crossed to each other substantially on a central streamline of the fluid between said first and second blades, from a view in a circumferential direction of the impeller structure.

3. An impeller structure of a closed type centrifugal pump for inelastic fluids, comprising:

front and rear shrouds having a driven connection with a pump drive shaft; and a series of blades provided between said front and rear shrouds for pressurizing an incoming inelastic fluid, and backwardly curved with respect to a rotational direction of the impeller structure and arranged circumferentially equi-distant, wherein an inner edge (17*a*) of a first blade of two adjacent blades of said series of blades is formed to be down-sloped from an inside wall of said rear shroud toward a substantially central portion of said front shroud, whereas an inner edge (17*c*) of a second blade of said two adjacent blades is formed to be down-sloped from an inside wall surface of said front shroud toward a substantially center portion of said rear shroud.

4. An impeller structure as claimed in claim 3, wherein said first and second blades are formed integral with said front and rear shrouds so that said inner edge (17*a*) of said first blade and said inner edge (17*c*) of said second blade are crossed to each other substantially on a central streamline of the fluid between said first and second blades, from a view in a circumferential direction of the impeller structure.

5. An impeller structure of a closed type centrifugal pump for inelastic fluids, comprising:

front and rear shrouds having a driven connection with a pump drive shaft;

said front shroud including an axially-extending inner peripheral portion, a radially-extending circumferential portion inclined to a radial direction of the impeller structure, and an inner curved wall with respect to a central streamline of an incoming inelastic fluid, said inner curved wall interconnecting said axially-extending inner peripheral portion and said radially-extending circumferential portion;

said rear shroud including an inner peripheral boss-like portion having an outer curved wall with respect to said central streamline of the inelastic fluid and a radially-extending circumferential portion having an essentially flat wall; and a series of blades provided between said front and rear shrouds for pressurizing the inelastic fluid, and backwardly curved with respect to a rotational direction of the impeller structure and arranged circumferentially equi-distant, wherein an inner edge (17*a*) of a center blade of three adjacent blades of said series of blades extends from said inner curved wall of said front shroud in such a manner as to be upsloped from an inside corner to an outside corner, whereas a respective inner edge (17*c*) of both blades on either side of said center blade of said three adjacent blades extends from said outer curved wall of said rear shroud in such a manner as to be up-sloped from an inside corner to an outside corner.

* * * * *